US011808484B2

(12) United States Patent
Takayanagi

(10) Patent No.: US 11,808,484 B2
(45) Date of Patent: Nov. 7, 2023

(54) DROPLET INFECTION SUPPRESSION SYSTEM AND DROPLET INFECTION SUPPRESSION METHOD

(71) Applicant: Panasonic Intellectual Property Management Co., Ltd., Osaka (JP)

(72) Inventor: Tetsuya Takayanagi, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 583 days.

(21) Appl. No.: 17/029,136

(22) Filed: Sep. 23, 2020

(65) Prior Publication Data

US 2021/0003301 A1 Jan. 7, 2021

Related U.S. Application Data

(63) Continuation of application No. PCT/JP2019/021282, filed on May 29, 2019.

(30) Foreign Application Priority Data

Jun. 28, 2018 (JP) ..... 2018-122965

(51) Int. Cl.
*F24F 9/00* (2006.01)
*F24F 11/79* (2018.01)
(Continued)

(52) U.S. Cl.
CPC ..... *F24F 9/00* (2013.01); *F24F 11/79* (2018.01); *F24F 2120/12* (2018.01); *F24F 2120/14* (2018.01)

(58) Field of Classification Search
CPC ..... F24F 9/00; F24F 11/79; F24F 2120/12; F24F 2120/14
(Continued)

(56) References Cited

U.S. PATENT DOCUMENTS 5,562,286 A * 10/1996 Brinket ..... A47B 25/00 273/287
5,765,635 A * 6/1998 Rhee ..... B60H 1/00742 454/189
(Continued)

FOREIGN PATENT DOCUMENTS

JP 3-013827 U 2/1991
JP 2010-117048 5/2010
(Continued)

OTHER PUBLICATIONS

International Search Report of PCT application No. PCT/JP2019/021282 dated Jul. 16, 2019.
(Continued)

*Primary Examiner* — Allen R. B. Schult
(74) *Attorney, Agent, or Firm* — Wenderoth, Lind & Ponack, L.L.P.

(57) ABSTRACT

A droplet infection suppression system includes an airflow generator capable of generating an airflow for separating a space into first regions, a first detector that detects human presence in each of the first regions, a second detector that detects coughing or sneezing in the space, and a controller which, when the second detector detects coughing or sneezing, controls the airflow generator to generate an airflow such that a second region including one or more first regions including a first region where human presence has been detected by the first detector is separated by the airflow from other regions.

10 Claims, 8 Drawing Sheets

(51) Int. Cl.
*F24F 120/12* (2018.01)
*F24F 120/14* (2018.01)

(58) Field of Classification Search
USPC ..... 454/192
See application file for complete search history.

(56) References Cited

U.S. PATENT DOCUMENTS

| | | | | |
|---|---|---|---|---|
| 9,050,382 | B2 * | 6/2015 | Carr | A61L 9/02 |
| 2012/0199003 | A1 | 8/2012 | Melikov et al. | |
| 2013/0130227 | A1 | 5/2013 | Peltz et al. | |
| 2014/0102442 | A1 * | 4/2014 | Wilson | F24F 9/00 128/200.28 |
| 2016/0069585 | A1 * | 3/2016 | Shrubsole | G05B 13/0205 700/276 |
| 2016/0325839 | A1 | 11/2016 | Wang | |

FOREIGN PATENT DOCUMENTS

| | | |
|---|---|---|
| JP | 2012-533720 | 12/2012 |
| JP | 2015-001319 | 1/2015 |
| JP | 2016-518077 | 6/2016 |

OTHER PUBLICATIONS

Zhiqiang Kang et al., "Numerical Simulation of Coughed Droplets in the Air-Conditioning Room", Procedia Engineering 121, Oct. 7, 2015, pp. 114-121.

* cited by examiner

DROPLET INFECTION SUPPRESSION SYSTEM AND DROPLET INFECTION SUPPRESSION METHOD

BACKGROUND

1. Technical Field

The present disclosure relates to a droplet infection suppression system for suppressing infection of an infectious disease, and a droplet infection suppression method.

2. Description of the Related Art

Infection of infectious diseases is transmitted via various routes, such as contact, droplet, or airborne transmission. For example, in the case of influenza, droplet infection or airborne infection is generally considered a primary route of infection. Therefore, when an infected person is present in a group of susceptible persons, if a susceptible person is exposed to coughing or sneezing of the infected person or if a susceptible person inhales influenza viruses or the like contained in an exhaled air emitted by the infected person, the susceptible person may be infected. In some cases, mass infection occur.

Kang Z., Zhang Y., Fan H., Feng G., Proc. Eng. (2015) pp. 114-121 discloses a result of a numerical simulation of how droplets are dispersed when an infected person coughs or sneezes in a ventilated room. According to this result, when a person coughs or sneezes at an initial velocity of 10 m/s, the droplets reach a susceptible person located 1 m away in about 5 seconds, and thus the susceptible person is exposed to the coughing or sneezing made by the infected person. Therefore, to prevent droplet infection, it is necessary to take action within a very short time shorter than 10 seconds to prevent the susceptible person from the droplets emitted by the infected person.

Japanese Unexamined Patent Application Publication No. 2010-117048 discloses an example of a technique for protecting a susceptible person from such droplet infection in a situation in which a doctor diagnoses a patient. In this technique disclosed in Japanese Unexamined Patent Application Publication No. 2010-117048, the doctor is surrounded by a clean booth and an airflow is generated from the clean booth. The doctor is located upwind and the patient is located downwind, thereby making it possible to prevent the doctor from being exposed to coughing by the patient.

Japanese Unexamined Utility Model Registration Application Publication No. 3-13827 discloses a desk provided with an air cleaner for the purpose of cleaning contaminated air or preventing passive smoking of tobacco. In the desk disclosed in Japanese Unexamined Utility Model Registration Application Publication No. 3-13827, a blowout port, an inlet port, and a dust removal filter are provided near the center of a desk, in which air is blown at a solid angle of about 180° from the blowout port over a wide area, which causes a large amount of airflow to circulate in the entire room. As a result, contaminated air is efficiently cleaned, and smoke is quickly diffused throughout the room which prevents passive smoking.

SUMMARY

However, for example, it is difficult to apply the technique disclosed in Japanese Unexamined Patent Application Publication No. 2010-117048 unless the infected person is known in advance.

Japanese Unexamined Utility Model Registration Application Publication No. 3-13827 does not disclose a technique for suppressing droplet infection.

One non-limiting and exemplary embodiment provides a technique capable of appropriately suppressing droplet infection caused by coughing or sneezing by an infected person.

In one general aspect, the techniques disclosed here feature a droplet infection suppression system including an airflow generator that generates an airflow for separating a space into first regions, a first detector that detects human presence in each of the first regions, a second detector that detects coughing or sneezing in the space, and a controller which, when the second detector detects coughing or sneezing, controls the airflow generator to generate an airflow such that a second region including one or more first regions including a first region where human presence is detected by the first detector is separated by the airflow from other regions.

The general or specific aspects may be implemented as an apparatus, a system, a method, an integrated circuit, a computer program, a computer-readable storage medium, or any selective combination of an apparatus, a system, a method, an integrated circuit, a computer program, and a computer-readable storage medium. The computer readable storage medium may be, for example, a non-transitory storage medium such as a compact disc-read only memory (CD-ROM), or the like.

According to the present disclosure, it is possible to appropriately suppress droplet infection caused by coughing or sneezing by an infected person.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Figure 1:
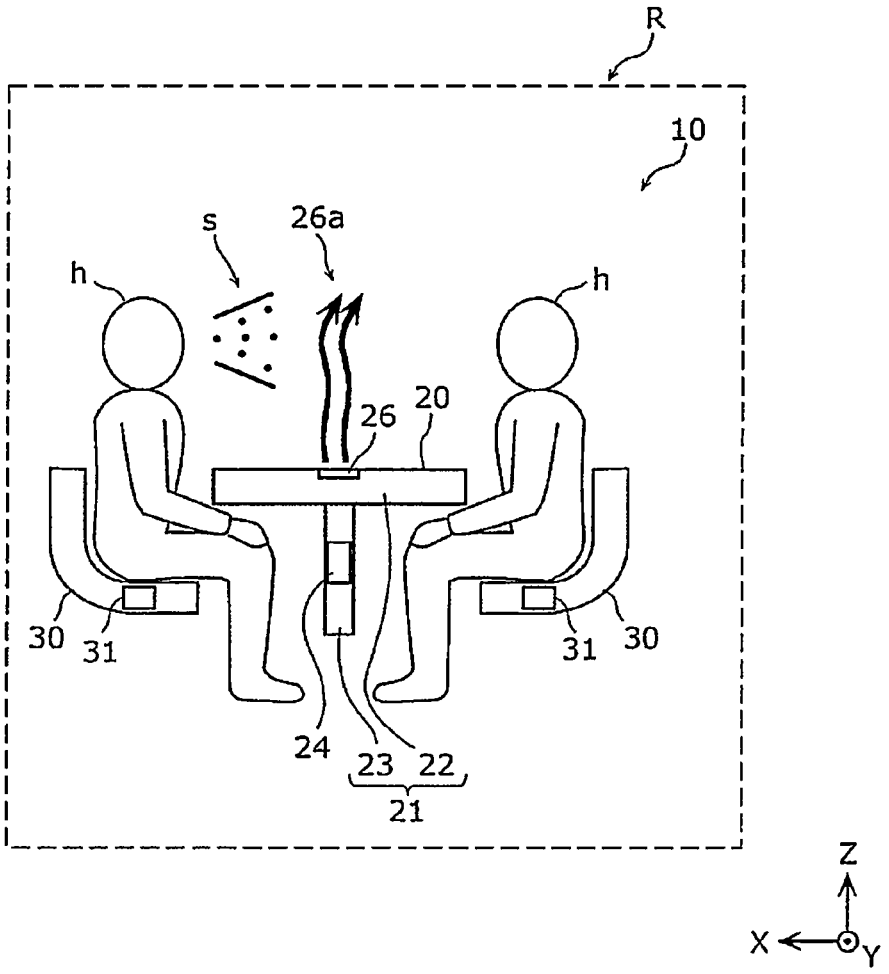
FIG. 1 is a diagram illustrating an outline configuration of a droplet infection suppression system according to Embodiment 1.

Underlying Knowledge Forming Basis of the Present Disclosure

When a susceptible person is exposed to a cough or sneeze emitted by an infected person and thus the susceptible person is infected with influenza, a high fever or a severe malaise usually occurs after an incubation period of one to t days. In particular, children or elderly people do not have high resistance to diseases, and thus when a child or an elderly person is infected with influenza, the disease is likely to become severe, and in the worst case, death occurs. Therefore, it is urgent to thoroughly implement influenza countermeasures in facilities such as nursing homes where many elderly people live. In nursing care facilities, various measures against infectious diseases are taken. For example, facility staff clean their hands well, and measures are taken based on infectious disease control manuals. However, infectious diseases are brought from outside the facilities, and mass infections periodically occur. As described above, influenza infection occurs mainly by droplet infection and airborne infection. Therefore, it is important to protect people from being exposed to coughing or sneezing made by an infected person.

From the above point of view, for example, it is difficult to apply the technique disclosed in Japanese Unexamined Patent Application Publication No. 2010-117048 unless the infected person is identified in advance. In addition, the system needs to include a clean booth or the like, which results in an increase in complexity, size, or the like of the system. This technique may be used to protect specific people, such as doctors, from droplet infection. However, this technique needs a large apparatus and is high in cost, and thus it is not practical to use this technique, for example, in a community room in a nursing home to protect all many elderly people present there.

Japanese Unexamined Utility Model Registration Application Publication No. 3-13827 includes no description of suppressing of droplet infection. Furthermore, to achieve the purpose of this technique, that is, to efficiently clean contaminated air, it is necessary to circulate an airflow throughout the room, and the flow rate required for this is large. Consequently, a large-scale system is necessary.

In view of the above, the inventor of the present application has conducted a thorough study on techniques of properly preventing susceptible persons from droplet infection, and has achieved a droplet infection suppression system capable of solving the problems described above. In this technique, in response to detecting a cough or a sneeze, an airflow is generated according to a position of a person existing in a space (for example, in an indoor room) in which the droplet infection suppression system is installed.

According to an aspect, the present disclosure provides a droplet infection suppression system including an airflow generator that generates an airflow for separating a space into first regions, a first detector that detects human presence in each of the first regions, a second detector that detects coughing or sneezing in the space, and a controller which, when the second detector detects coughing or sneezing, controls the airflow generator to generate an airflow such that a second region including one or more first regions including a first region where human presence has been detected by the first detector is separated by the airflow from the other regions.

In this droplet infection suppression system, the controller performs control such that the airflow is generated in response to detecting coughing or sneezing. Thus, even in a situation in which an infected person is not identified in advance, the airflow suppresses droplets, generated by coughing or sneezing made by the infected person, reaching another person. That is, it is possible to suppress infection to other persons via coughing or sneezing. To achieve the above, the controller controls the airflow generator to generate the airflow so as to separate the second region including the first region in which some person is present from the other region. The controller controls the airflow generator, capable of generating an airflow for separating the space into first regions, to generate a local airflow such that the second region is separated by the local airflow from the other regions. As described above, the droplet infection suppression system can suppress droplet infection by generating a local airflow even when the location of the infected person is unknown. Therefore, the droplet infection suppression system according to the present embodiment can appropriately suppress droplet infection caused by coughing or sneezing of an infected person. In this droplet infection suppression system, it is sufficient for the airflow generator to locally generate an airflow. Therefore, the droplet infection suppression system can be realized in a small form, and the power consumption can be reduced as compared with the case where an airflow is generated from the entire airflow generator.

In a case where the first detector detects human presence in two or more first regions of the first regions, the controller controls the airflow generator to generate an airflow so as to separate the two or more first regions from each other.

Thus, when coughing or sneezing is detected, persons present in two or more respective first regions can be separated from each other by the airflow. Thus, droplet infection can be suppressed without identifying the person who coughs or sneezes. Thus, it becomes possible to further appropriately suppress droplet infection caused by coughing or sneezing by an infected person.

Ina case where the first detector detects human presence in two or more first regions of the first regions, the second detector detects a first region, of the two or more first regions, in which a person who has coughed or sneezed is present, and the controller controls the airflow generator to generate an airflow such that the second region including the first region, in which the person who has coughed or sneezed is present, detected by the second detector is separated by the airflow from the other regions.

Thus, when the coughing or sneezing is detected, it is sufficient to generate the airflow such that the first region in which the person who coughed or sneezed is present is separated by the airflow from the other regions. Thus, it is possible to suppress droplet infection while reducing the flow rate of airflow generated. Thus, it becomes possible to further appropriately suppress droplet infection caused by coughing or sneezing by an infected person.

The droplet infection suppression system may further include a desk, in which the airflow generator may be included in the desk, and the airflow generator generates an airflow upward from the desk.

Thus, when an infected person coughs or sneezes in a situation where two or more persons are present around a desk, the airflow is generated upward thereby suppressing droplets reaching a susceptible person. Thus, even in a situation where two or more persons are present around the desk, it is possible to further appropriately suppress droplet infection caused by coughing or sneezing by an infected person.

The airflow generator may have a lattice shape in plan view of the desk.

Thus, it is possible to generate the airflow appropriately depending on the first region in which the person is present.

The second detector may be included in the desk.

Thus, the desk may not include a component such as a wireless communicator for communicating with the detector. Thus, it is possible to reduce the desk size.

The second detector may include a microphone or a camera.

This makes it possible to realize the detector using the microphone or camera which may be of a widely used type. Thus, the versatility of the droplet infection suppression system is improved.

A chair may be further provided, and the first detector may be included in the chair.

Thus, the first region in which the person is present can be easily detected by detecting whether the person is seated on the chair or not.

The first detector may include an infrared sensor or a pressure sensor.

This makes it possible to realize the human detector by using the infrared sensor or pressure sensor which may be of a widely used type. Thus, the versatility of the droplet infection suppression system is improved.

According to an aspect, the present disclosure provides a droplet infection suppression method, including detecting human presence for each of first regions, detecting coughing or sneezing, and controlling, in a case where coughing or sneezing is detected, an airflow generator to generate an airflow such that a second region including one or more first regions including a first region where human presence is detected is separated by the airflow from the other regions.

Thus, similar effects to those obtained in the droplet infection suppression system can be obtained.

Note that the general or specific aspects may be implemented by a system, an apparatus, a method, an integrated circuit, a computer program, a non-transitory computer-readable storage medium such as a CD-ROM, or any selective combination of a system, an apparatus, a method, an integrated circuit, a computer program, and a storage medium.

Embodiments of the present disclosure are described in detail below with reference to FIGS. 1 to 8.

Note that any embodiment described below is provided to illustrate a general or specific example. Numerical values, shapes, materials, components, positions and connection forms of components, steps, the order executing the steps, and the like shown in the following embodiments are only examples and are not intended to limit the scope of claims. Among constituent elements described in the following embodiments, those constituent elements that are not described in independent claims indicating highest-level concepts of the present disclosure are optional.

Note that the drawings are schematic, and they are not necessarily strict descriptions. Throughout the figures, substantially identical elements are denoted by the same reference numerals, and redundant descriptions thereof are omitted or simplified.

In the present specification, the terms "upward" and "downward" refer to an upward direction (a vertically upward direction) and a downward direction (a vertically downward direction) in an absolute space recognition. Note that "upward" and "downward" are expressions which may be completely or substantially identical to "vertically upward" and "vertically downward". For example, "upward" and "vertically upward" may include an error of several percent.

In the present specification and drawings, an X axis, a Y axis, and a Z axis indicate three axes in a three-dimensional orthogonal coordinate system. In each embodiment, an X-axis direction and a Y-axis direction are parallel to an installation plane on which an airflow generator is installed, and a Z-axis direction is perpendicular to the installation plane. Furthermore, in the present specification, the term "in plan view" is used to describe a configuration or a structure of the droplet infection suppression system as seen in a direction perpendicular to the installation plane.

In the present specification, a term indicating a relationship between elements, such as "parallel", a term indicating a shape of an element such as a "rectangle (or rectangular)", and numerical values and numerical ranges are not strict expressions, but they represent substantially equivalent values or ranges and they may have differences of a few percent.

In the present specification, "infection" refers to invasion of microorganisms such as viruses, bacteria, or the like into a living body, and a person having therein such microorganisms is also referred to as an infected person. A person who is not invaded by such microorganisms, that is, a not infected person is referred to as a susceptible person.

Embodiment 1

The droplet infection suppression system and related matters according to Embodiment 1 are described below with reference to FIGS. 1 to 6.

1. Overview of Droplet Infection Suppression System

First, a configuration of the droplet infection suppression system 10 according to Embodiment 1 are described with reference to FIG. 1 and FIG. 2.

Figure 2:
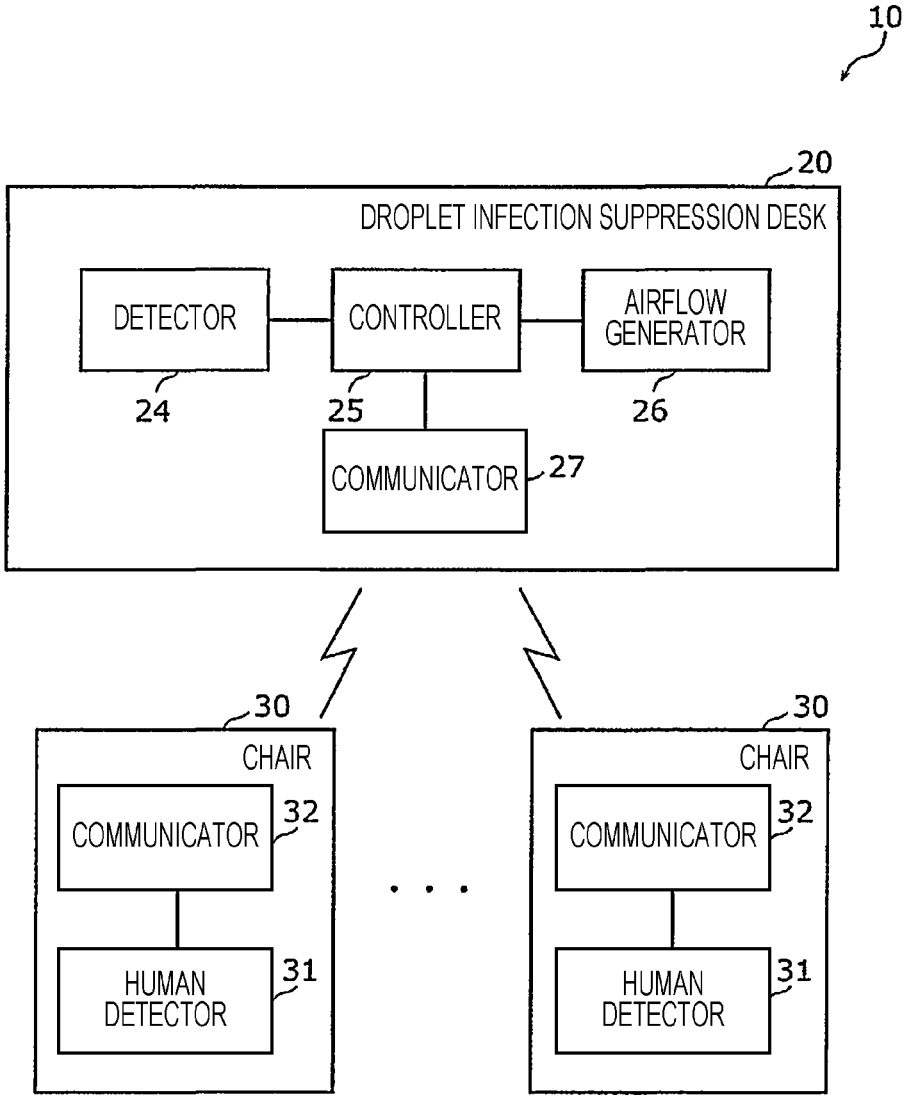
FIG. 2 is a block diagram illustrating a functional configuration of the droplet infection suppression system according to Embodiment 1.

FIG. 1 is a diagram illustrating an outline of a configuration of the droplet infection suppression system 10 according to the present embodiment. FIG. 2 is a diagram illustrating a functional configuration of the droplet infection suppression system 10 according to the present embodiment.

As shown in FIG. 1, the droplet infection suppression system 10 includes a droplet infection suppression desk 20 (hereinafter also referred to as a desk 20) and a chair 30. The desk 20 and the chair 30 are installed in a space R. The space R is a space where persons h gather and sit on the chairs 30 and may communicate with each other at the desk 20. Examples of the space R are a community room of a nursing facility, a meeting room of a company, a restaurant, etc. The space R may be, for example, a space (a closed space) in a moving body (a vehicle, an airplane, etc.) persons h get on. The space R may be an outdoor space. The number of desks 20 and the number of chairs 30 installed in the droplet infection suppression system 10 are not particularly limited.

In the following description, it is assumed by way of example that the droplet infection suppression system 10 includes the desk 20 and the chairs 30, but the configuration of the droplet infection suppression system 10 is not limited to this example. The droplet infection suppression system 10 may not include the desk 20 or the chairs 30. For example, in a case where the droplet infection suppression system 10 is installed in a mobile object, the droplet infection suppression system 10 may include only the chairs 30 without including the desk 20.

The person h denotes a person who is present in the space R. More specifically, the person h may be a person who is present in the space R for the purpose of having a conversation in a community room or the like. In the present embodiment, basically, it is not determined whether the person h is infected with an infectious disease. When a person is infected with an infectious disease, the person has a potential of infecting other people for an infective period and has a symptom of the disease for a symptom period, which is generally different from the infective period. Note that an infected person has a potential of infecting other people much earlier than a symptom such as an increase in a body temperature or the like actually appears which makes it possible for people to perceive that the person is infected. It is extremely difficult to detect the moment when a person becomes infectious, that is, the moment when the person gets infected, with the current technology. Therefore, it is not determined whether the person is infected or not. However, in a case where it is known in advance by a doctor's diagnosis or some measurement that the person h is an infected person, this information may be taken into account in the control by the droplet infection suppression system 10. More specifically, for example, the droplet infection suppression system 10 may be operated only when an infected person coughs or sneezes. In the following description, it is assumed by way of example that it is not determined whether or not the person h is infected with an infectious disease.

The desk 20 is, for example, a desk to be used by the person h for communication and the like, but the use of the desk 20 is not limited to this example. The desk 20 may be a work table for performing a work, or may be of another type used by people gathering around the desk. As shown in FIGS. 1 and 2, the desk 20 includes a main part 21, a detector 24, a controller 25, an airflow generator 26, and a communicator 27. In the present embodiment, the number of detectors 24 included in the droplet infection suppression system 10 is, for example, one.

The main part 21 of the desk 20 includes a top plate 22 and support legs 23. For example, the detector 24 and the airflow generator 26 may be embedded in the main part 21.

The top plate 22 is a plate-like element for use by the person h to place a document and/or the like thereon. The top plate 22 may be, for example, a flat plate or a curved plate. The shape of the top plate 22 in plan view is not particularly limited. The shape may be rectangular, circular, or polygonal. The material of the top plate 22 is not particularly limited, and can be appropriately selected from wood, metal, resin, and the like.

The support legs 23 extend downward from the top plate 22 so as to support the top plate 22. The shapes of the support legs 23 are not particularly limited, and any shape may be employed as long as the desk 20 is stably supported on an installation surface (for example, a floor). The number of the support legs 23 is not particularly limited and may be equal to or larger than 2. The material of the support legs 23 is not particularly limited, and may be suitably selected from wood, metal, resin, and the like.

The detector 24 detects coughing or sneezing of persons h present in the space R. In the present embodiment, the detector 24 continuously detects both coughing and sneezing. The detector 24 detects, for example, coughing and sneezing of persons h sitting on the chairs 30 in the space R. The detector 24 outputs a detection result to the controller 25. The detector 24 is an example of the second detector.

The detector 24 may include, for example, a sound pickup device (for example, a microphone). The detector 24 detects that a person h has coughed or sneezed, for example, via a voice detection with a microphone. The detector 24 is capable of determining whether the voice acquired by the microphone is of a cough or a sneeze by analyzing the spectrum of the voice. In this determination process, a threshold value of the sound magnitude (dB) may be set. More specifically, the detector 24 may selectively detect coughing or sneezing of a seated person h by determining that the spectrum lower than the threshold is excluded as not the object of detection.

The detector 24 may include an image capturing apparatus (for example, a camera). The detector 24 may detect coughing or sneezing by performing image processing and analysis on an image captured by the image capturing apparatus. In this case, it is possible to easily determine whether or not coughing or sneezing is detected by classifying an operation pattern obtained as a result of the image processing by a classification algorithm such as machine learning or the like. The detector 24 may be configured by a combination of a sound pickup device and an image capturing apparatus.

The detector 24 may be incorporated, as a part, into the desk 20. In this configuration, unlike a configuration in which the detector 24 is installed outside the desk 20, it is not necessary to provide a communicator for communication between the desk 20 and the detector 24. Furthermore, it is possible to install the detector 24 near a region in which coughing or sneezing occurs, which makes it possible to accurately detect coughing or sneezing of a person h communicating at the desk 20 with another person. To embed the detector 24, as a part into the desk 20, for example, a small microphone may be embedded in the desk 20.

The detector 24 is not limited to being installed on the desk 20. The detector 24 may be installed at an appropriate position in the space R where the desk 20 is installed as along as it is possible to detect coughing and sneezing. In this case, when the detector 24 detects coughing or sneezing, the detector outputs, to the desk 20, a detection flag indicating that coughing or sneezing is detected. The desk 20 acquires the detection flag via the communicator 27. The detector 24 may have a memory for storing detected information.

The controller 25 is a control apparatus for controlling various components of the desk 20. The controller 25 controls the airflow generator 26 to generate a particular airflow according to a result of a detection of coughing and sneezing by the detector 24 and a result of a detection of a person on a chair 30. In the present embodiment, the controller 25 controls the airflow generator 26 so as to generate a local airflow upward. More specifically, when coughing or sneezing is detected, the controller 25 controls the airflow generator 26 to generate an airflow such that a region where a person h is detected by the human detector 31 is separated by the airflow from the other region. The controller 25 may have a real-time clock function for acquiring the current year, month, date and time.

A wind velocity of the airflow generated by the airflow generator 26 under the control of the controller 25 is described below with reference to FIG. 1. The wind velocity of the airflow generated by the airflow generator 26 under the control of the controller 25 is determined, for example, depending on the size of the desk 20 and the distance from the airflow generator 26 to a mouth of the person h in the Z-axis direction and that in the horizontal direction. As shown in FIG. 1, when a person h located on the left side coughs or sneezes toward a facing person h, it is necessary to generate an airflow **26*a* such that the airflow 26*a* reaches the height of the cough or sneeze droplets s before the cough or sneeze droplets s pass over the airflow generator 26. To achieve this, the controller 25 controls the airflow generator 26 to generate the airflow 26***a* with a wind velocity that allows the airflow 26*a* to reach the height of the cough or sneeze droplets s within a period in which the cough or sneeze droplets s pass over the airflow generator 26. The wind velocity of the airflow 26*a* controlled by the controller 25 is, for example, several m/s. The velocity of droplets s generated by coughing or sneezing may be assumed to be, for example, 10 m/s. The height at which the droplets s fly may be calculated, for example, from the average height of people (with various attributes such as a child or adult, etc.) using the space R in which the droplet infection suppression system 10 is installed. The wind velocity of the airflow 26*a* may be set taking into account a time lag from the detection of coughing or sneezing by the detector 24 to the generation of the airflow 26*a* by the airflow generator 26. That is, the wind velocity may be set based on the time spent by the droplets s reaching a location above the airflow generator 26, the height of the droplets s, and the time lag. This further ensures suppression of the droplets s reaching the facing person h.

The airflow generator 26 is an apparatus capable of generating an airflow such that a space in which the droplet infection suppression system 10 is installed is separated by the airflow into regions (first regions A1 described later with reference to FIG. 4). In the present embodiment, the airflow generator 26 is capable of separating the space above an object (the desk 20, in the present embodiment), in which the airflow generator 26 is installed, into regions. More specifically, the airflow generator 26 generates an airflow under the control of the controller 25 such that a particular region (a region including one or more of the regions, such as a second region A2 described later with reference to FIG. 4) of the regions is separated by the airflow from the other regions.

Note that in the present specification, the term "separate (or separation)" refers to a process of separating two different regions (for example, two different second regions A2) by generating an airflow between the two regions thereby blocking flowing of air between these two regions. More specifically, the "separation" refers to the separation between two different regions achieved by generating a wall of an airflow reaching the location of the droplets s thereby blocking flowing of air between these two regions. The term "separate persons" refers to blocking flowing of air between two different regions (for example, two different second regions A2) in which persons are present by generating an airflow between the two regions.

In the present embodiment, airflow generator 26 is installed such that it is embedded in an upper part of the top plate 22 of the desk 20.

The airflow generator 26 may be realized using a device such as a direct current (DC) fan that generates an airflow. By embedding airflow generation apparatus such as DC fans in the form of an array in the desk 20, it is possible to generate an airflow not in the form of a spot airflow but in the form of a planar airflow such as an air curtain. In other words, the airflow generator 26 is an apparatus that generates a planar airflow such as an air curtain.

The term "air curtain" indicates a concept similar to the concept of a commonly used term "air curtain", and does not indicate a particular unusual concept, but indicates a wall-like air curtain formed by an airflow. That is, in the present embodiment, the air curtain has a function of blocking a flow of air across the air curtain. In this regard, the airflow generator 26 is different from an air conditioner that has a function of blowing air to circulate or mix the air so as to efficiently transmit temperature thereby achieving a main purpose of adjusting the temperature.

The airflow generator 26 is preferably installed at an intermediate position between facing persons h (in the example shown in FIG. 1, at a position which is intermediate in the X-axis direction between two opposing persons h). This makes it possible to suppress droplet infection to a similar degree regardless of which one of the facing persons h coughs or sneezes.

The communicator 27 acquires, from chairs 30, a signal indicating that presence of a person h is detected. The communicator 27 includes a communication circuit. In a case where the desk 20 includes the detector 24 and the human detector 31, the communicator 27 may not be provided.

In a case where the communicator 27 is a wireless communication circuit, it receives a signal transmitted from a chair 30, and the relative positional relationship between the chair 30 and the desk 20 is detected according to the direction and intensity of the received signal. That is, it is possible to detect which chair 30 a person h is sitting on. The desk 20 may include two or more communicators 27 to achieve a higher accuracy in detecting the relative positional relationship between the desk 20 and the chair 30.

The chairs 30 for use by persons h to sit on are provided around the desk 20. As shown in FIGS. 1 and 2, each chair 30 includes a human detector 31 and a communicator 32.

The human detector 31 detects whether or not a person h seating on a chair 30 is present. The human detector 31 is realized, for example, by an infrared sensor or a pressure sensor embedded in the chair 30. This makes it possible to easily detect a person h, and it becomes possible to easily implement the system. In a case where the human detectors 31 are included in the chairs 30, one human detector 31 is included in each of the chairs 30. In this configuration, when a large number of persons communicate simultaneously in a community room in a nursing facility or a meeting room in an office, it is possible to easily determine positions where persons are present (are sitting).

The installation position of the human detector 31 is not limited to the chair 30. For example, the human detector 31 may be installed separately from the chair 30. For example, the human detector 31 may be installed in the desk 20. The human detector 31 may be an image capturing apparatus or an acquirer that detects a person by receiving a signal from a wearable sensor such as a tag or the like worn by a person h. The human detector 31 is an example of the first detector.

When the human detector 31 detects a person h, the communicator 32 outputs, to the desk 20, a signal indicating the detection of the person h. The communicator 32 may continuously output the signal while the human detector 31 detects the person h, or may output signals indicating the start and end of detection of the person h.

2. Operation of the Droplet Infection Suppression System

Next, an operation of the droplet infection suppression system 10 according to the present embodiment is described below with reference to FIGS. 3 to 6.

Figure 3:
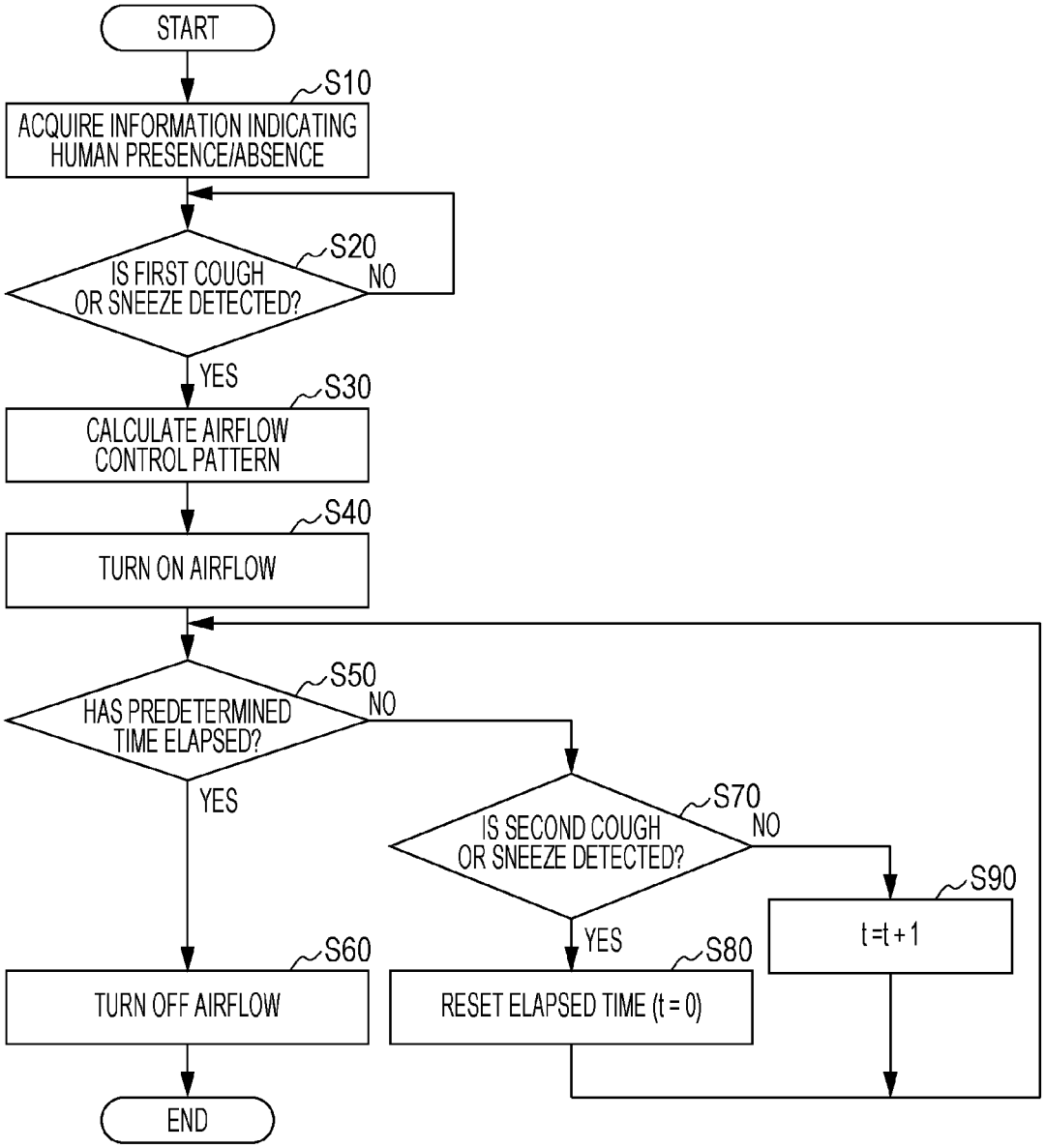
FIG. 3 is a flowchart illustrating an example of an operation of the droplet infection suppression system according to Embodiment 1.

FIG. 3 is a flowchart illustrating an example of an operation of the droplet infection suppression system 10 according to the present embodiment. In FIG. 3, it is assumed that each component of the droplet infection suppression system 10 is powered on.

As shown in FIG. 3, first, the desk 20 acquires information on human presence/absence from the chairs 30 (S10). The controller 25 acquires information on the human presence/absence from each of the two or more chairs 30 via the communicator 27. More specifically, for example, the controller 25 receives, from a chair 30, information indicating that the human detector 31 installed in the chair 30 has detected presence of a person, thereby acquiring information on the human presence/absence. In other words, the human detectors 31 perform the human presence/absence detection on the respectively chairs 30. Thus, the controller 25 can detect whether a human is sitting on a chair for each of the chairs 30. In a case where two or more persons h are seated on chairs 30, the controller 25 is capable of determining which person h is sitting on which chair 30 from results of detections made by the respective human detectors 31. That is, the controller 25 can determine a person h sitting on a particular chair 30 to be protected from coughing or sneezing.

Figure 4:
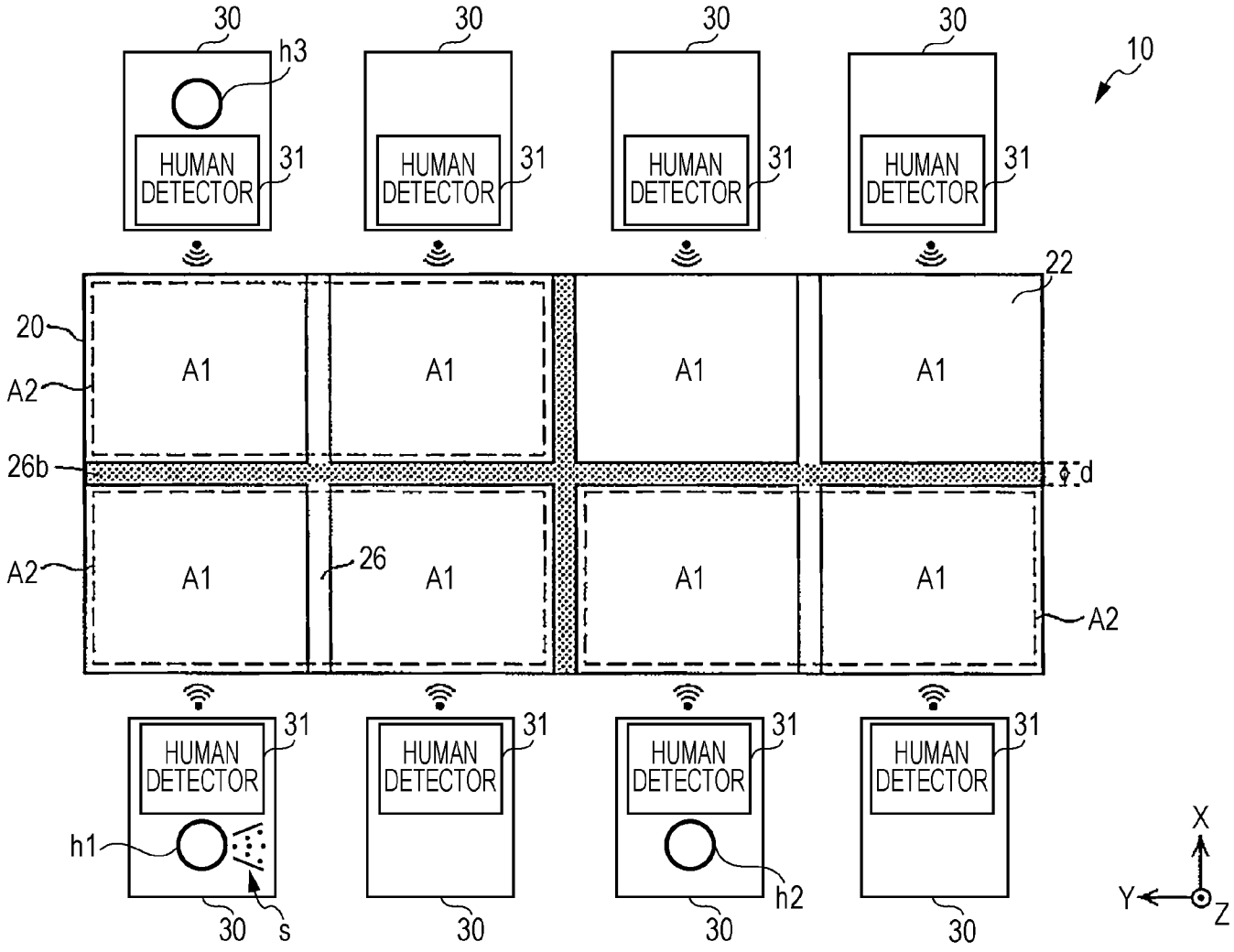
FIG. 4 is a diagram illustrating an example in which a region separation by an airflow is performed in response to detecting a cough or a sneeze in the droplet infection suppression system according to Embodiment 1.

Note that detecting human presence/absence performed by the human detector 31 for the respective chairs 30 in step S10 corresponds to detecting human presence/absence for the respective first regions (first regions A1 shown in FIG. 4). Note that step S10 is an example of a step of detecting human presence in each of the first regions A1.

Next, the detector 24 determines whether or not first coughing or sneezing is detected (S20). The controller 25 acquires a result of a detection made by the detector 24 (for example, a microphone embedded in the desk 20). In the present embodiment, no determination is made as to where the coughing or sneezing has occurred around the desk 20. That is, no determination is made as to which of the persons h sitting on the chairs has coughed or sneezed. Step S20 is an example of a step of detecting coughing or sneezing.

In a case where the detector 24 detects an occurrence of coughing or sneezing (Yes in S20), the controller 25 calculates an airflow control pattern according to the position of the person h (S30). More specifically, the controller 25 calculates the airflow pattern that separates the persons h sitting on the chairs to prevent the persons h from being exposed to droplets. Since the controller 25 does not determine which one of the persons h has coughed or sneezed, the controller 25 calculates the airflow pattern of the airflow 26*a* so as to separate the persons h from each other. More specifically, the controller 25 calculates the airflow pattern of the airflow 26*a* so as to separate the respective regions where persons h are present from each other. Based on the calculated airflow pattern, the controller 25 controls the airflow generator 26 to turn on the airflow 26*a* (S40). That is, the controller 25 controls the airflow generator 26 to start generating the airflow 26*a*. In the present embodiment, the controller 25 controls the airflow generator 26 to generate the airflow 26*a* upward. When the airflow generator 26 starts generating the airflow 26*a*, the controller 25 starts measuring the elapsed time during which the airflow 26*a* is generated.

The pattern of the airflow generated by the airflow generator 26 is described in further detail below with reference to FIG. 4. FIG. 4 is a diagram illustrating an example of separating regions by the airflow when an occurrence of coughing or sneezing is detected by the droplet infection suppression system 10 according to the present embodiment. Note that in FIG. 4 is a view illustrating the desk 20 in plan view.

In the example shown in FIG. 4, the airflow generator 26 is provided in the form of a lattice in the top plate 22 of the desk 20. The airflow generator 26 is formed so as to extend, for example, in a direction parallel to the longitudinal direction and a direction parallel to the lateral direction of the desk 20. The airflow generator 26 is provided so as to be capable of generating the airflow such that the space above the desk 20 is separated into eight first regions A1. The airflow generator 26 may be provided such that the areas of the first regions A1 separated by the airflow generator 26 are equal to each other. It is assumed by way of example that the droplet infection suppression system 10 includes eight chairs 30, three of which are each occupied by a person. The width d of the airflow generator 26 is determined according to, for example, an assumed size of droplets s. For example, the width d of the airflow generator 26 is about 1 cm. In FIG. 4, a dot shaded part indicates a part of the airflow generator 26 from which an airflow is being blown out.

Note that the airflow generator 26 is not limited to having a lattice shape. Any shape may be employed as long as it does not interfere with the function of the desk 20. When the desk 20 is used in a conference room or the like, to prevent documents or the like on the desk 20 from being blown by the airflow, the airflow generator 26 is not provided on the entire surface of the top plate 22.

In step S10, the controller 25 acquires information indicating that three persons h1 to h3 are seated in the positions shown in FIG. 4. Assume here that the person h1 has coughed or sneezed. That is, in the example shown in FIG. 4, the person h1 is an infected person and the persons h2 and h3 are susceptible persons. When the detector 24 detects the coughing or sneezing by the person h1, the controller 25 calculates an airflow pattern to be generated to separate the persons (h1 to h3) from each other, and controls airflow generator 26 to generate an airflow 26*b* according to the calculated airflow pattern. More specifically, the controller 25 controls the airflow generator 26 to blow the airflow from the part corresponding to the airflow pattern. That is, the controller 25 controls the airflow generator 26 to generate an airflow such that a second region A2, including one or more first regions A1 including the first region A1 where the person detected by the human detector 31 is present, is separated by the airflow from the other regions. In other words, the controller 25 controls the airflow generator 26 to generate the airflow such that the first region A1 in which the person detected by the first detector 31 is present is separated by the airflow from at least one other first region A1.

In the specific example shown in FIG. 4, the controller 25 performs control to generate the airflow such that the space is separated into second regions A2 each including two first regions A1 adjacent to each other in the Y-axis direction (in the direction in which persons are located side by side). More specifically, for example, as a result of the control by the controller 25, a second region A2 including two first regions A1 including a first region A1 in which the person h1 is present is separated by the generated airflow from the other regions. Furthermore, a second region A2 including two first regions A1 including a first region A1 in which the person h2 is present is separated by the generated airflow from the other regions, and a second region A2 including two first regions A1 including a first region A1 in which the person h3 is present is separated by the generated airflow from the other regions.

Thus, even when the person who coughs or sneezes is not identified, it is possible to suppress exposure of sitting persons (for example, persons h2 and h3) other than the person who coughs or sneezes (for example, the person h1) to droplets. In this example, a cross-shaped part of the lattice-shaped airflow generator 26 is operated thereby suppressing droplet infection. In other words, droplet infection can be suppressed without operating the entire area of the airflow generator 26.

Figure 5:
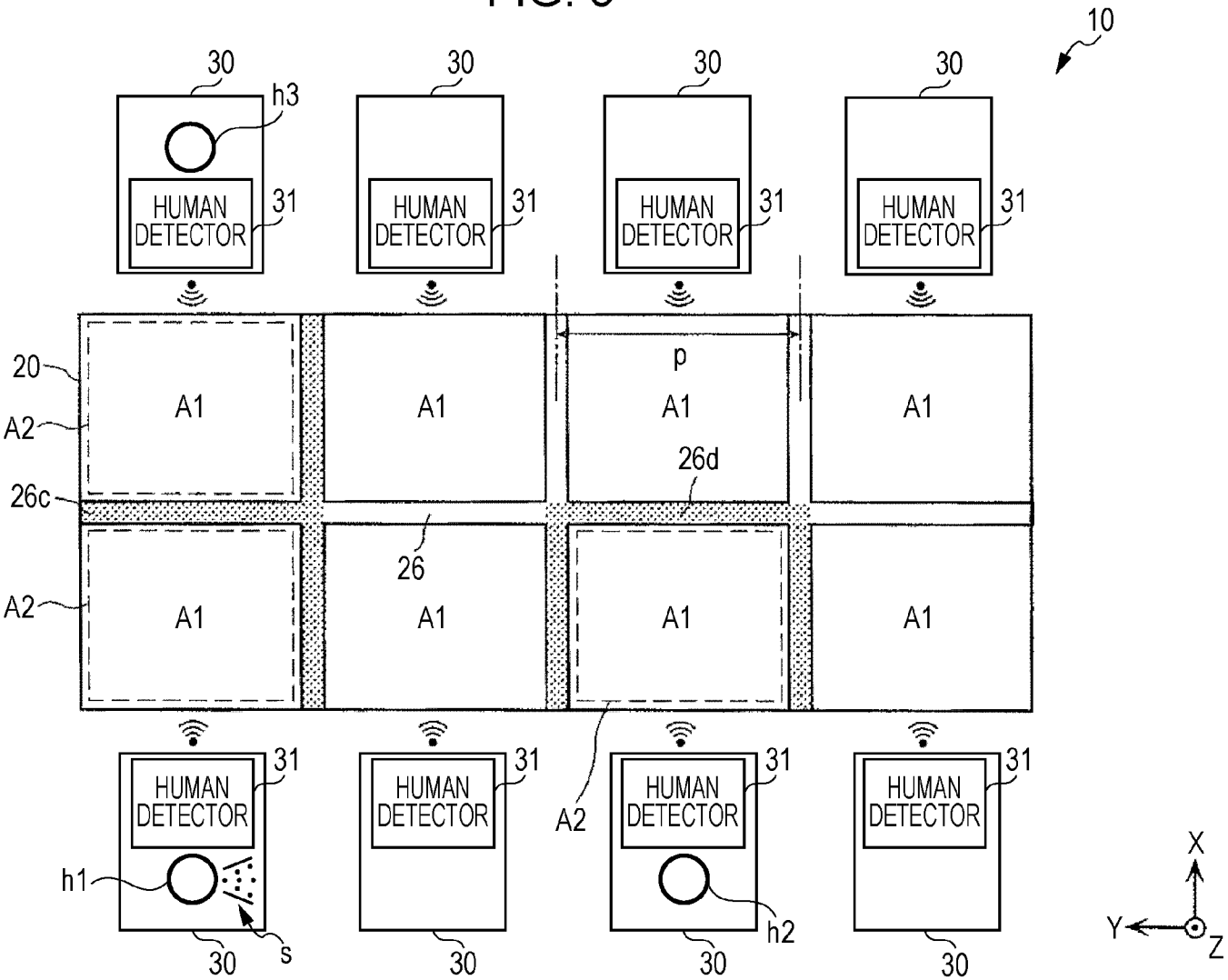
FIG. 5 is a diagram illustrating another example in which a region separation by an airflow is performed in response to detecting a cough or a sneeze in the droplet infection suppression system according to Embodiment 1.

The airflow pattern is not limited to the pattern shown in FIG. 4. Other examples of the airflow pattern are described with reference to FIGS. 5 and 6. FIG. 5 is a diagram illustrating another example in which the droplet infection suppression system 10 according to the present embodiment generates an airflow for separating regions in response to detecting an occurrence of coughing or sneezing. The pitch p of the lattice-shape airflow generator 26 may be, for example, equal to an interval (at which chairs 30 are placed) at which persons sit. For example, the pitch p is about 50 cm to 100 cm. Note that the pitch p is a distance between parts that are extending in parallel among the parts for partitioning the first regions A1 of the airflow generator 26. More specifically, the pitch p is defined by a distance between the centers (for example, the centers of width d) of the parallel parts.

As shown in FIG. 5, when the detector 24 detects an occurrence of coughing or sneezing, the controller 25 may generate an airflow so as to surround each of the persons h to h3. That is, the controller 25 may control the airflow generator 26 to generate an airflow such that a second region A2 including a first region A1 where a person is detected is separated by the airflow from the other regions. More specifically, the controller 25 may control the airflow generator 26 to generate an airflow 26*c* and an airflow 26*d* such that first regions A1 in which persons h1 and h2 are respectively present are partitioned by the airflow 26*c* and a first region A1 in which a person h2 is present is partitioned by the airflow 26*d*.

Figure 6:
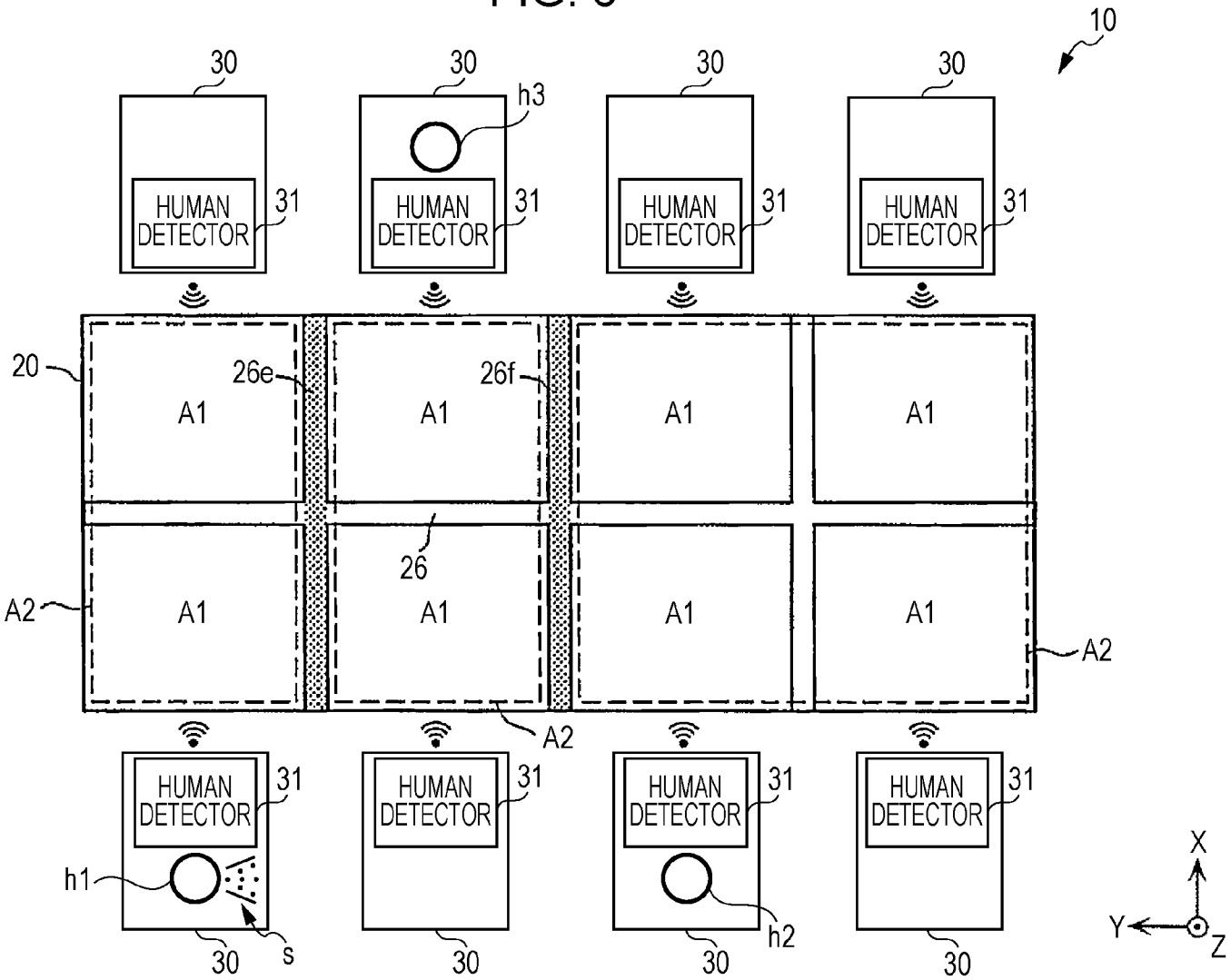
FIG. 6 is a diagram illustrating still another example in which a region separation by an airflow is performed in response to detecting a cough or a sneeze in the droplet infection suppression system according to Embodiment 1.

FIG. 6 is a diagram illustrating another example in which the droplet infection suppression system 10 according to the present embodiment generates an airflow for separating regions in response to detecting an occurrence of coughing or sneezing. This example is different from the examples shown in FIGS. 4 and 5 in the location where the person h3 is sitting.

As shown in FIG. 6, when the detector 24 detects an occurrence of coughing or sneezing, the controller 25 may perform control to generate an airflow so as to surround each of the persons h to h3. In the specific example shown in FIG. 6, the controller 25 performs control to generate an airflow such that the space is separated into second regions A2 each including two first regions A1 adjacent to each other in the X-axis direction (in the direction in which persons face each other). The controller 25 generates, for example, an airflow such that a second region A2 including two first regions A1 including a first region A1 in which the person h1 is present is separated by the airflow from the other regions. Furthermore, the controller 25 performs control to generate an airflow such that a second region A2 including two first regions A1 including a first region A1 in which the person h3 is present is separated by the airflow from the other regions. Furthermore, the controller 25 performs control to generate an airflow such that a second region A2 including four first regions A1 including a first region A1 in which the person h2 is present is separated by the airflow from the other regions. As shown in FIG. 6, when the second regions A2 are partitioned, the shapes, as seen in plan view, of the second regions A2 may be different from each other, the number of first regions included in each second regions A2 may be different among the second regions A2. For example, the controller 25 controls the airflow generator 26 to generate an airflow 26*e* and an airflow 26*f* such that persons h1 and h3 are separated from each other by the airflow 26*e* and persons h2 and h3 are separated from each other by the airflow 26*f*.

The controller 25 may control the airflow generator 26 to generate airflows of an airflow pattern other than those shown in FIGS. 4 to 6, if the airflow pattern can separate from each other a second region A2 including a first region A1 in which a person h is present, a second region A2 including a first region A1 in which a person h2 is present, and a second region A2 including a first region A1 in which a person h3 is present. The step S40 is an example of a step of controlling the airflow generator 26 to generate an airflow so as to separate a second region A2 from the other regions.

Referring again to FIG. 3, next, the controller 25 determines whether or not a predetermined time has elapsed since the start of the generation of the airflow (for example, the airflow 26*b*) by the airflow generator 26 (S50). In a case where the controller 25 determines that the predetermined time has elapsed (Yes in S50), the controller 25 controls the airflow generator 26 to turn off the airflow 26*b* (S60). That is, the controller 25 controls the airflow generator 26 to stop the generation of the airflow 26*b*. The predetermined time may be a time in which the risk of droplet infection due to coughing or sneezing becomes lower than a predetermined level. The predetermined time may be set according to the size or the like of the desk 20. The predetermined time may be set to be longer as the size of the desk 20 is larger. The predetermined time may be set to, for example, 1 to 5 minutes.

In a case where the controller 25 determines that the predetermined time has not elapsed (No in S50), a further determination is made as to whether or not second coughing or sneezing has been detected (S70). The second coughing or sneezing is coughing or sneezing that occurs after the first coughing or sneezing. In a case where the controller 25 detects an occurrence of the second coughing or sneezing, that is, if the controller 25 detects an occurrence of the second coughing or sneezing when the airflow 26*b* started in response to detecting the first coughing or sneezing is still continued (Yes in S70), the controller 25 resets the elapsed time t (such that t=0) (S80), and starts measuring the elapsed time t from the beginning. In other words, when the controller 25 detects an occurrence of the second coughing or sneezing when the airflow 26*b* started in response to detecting the first coughing or sneezing is still continued, the controller 25 stops the measurement of the elapsed time t started in response to detecting the first coughing or sneezing, and starts the measurement of the elapsed time t in response to detecting the second coughing or sneezing. The controller 25 performs control such that when the predetermined time has elapsed since the last detection of coughing or sneezing, the controller 25 stops the airflow 26*b*. Thus, it is possible to suppress an occurrence of droplet infection due to the second coughing or sneezing that occurs during the generation of the airflow 26*b*. If the second coughing or sneezing is not detected (No in S70), the count of the elapsed time t is incremented by 1 (such that t=t+1) (S90), and the process returns to step S50 to again determine the elapsed time.

Note that the first coughing or sneezing and the second coughing or sneezing may be made by the same person or different persons.

In the above description with reference to FIG. 4, it is assumed by way of example that three persons h1 to h3 are present. In a case where there is only one sitting person (for example, the person h1), the controller 25 may control the airflow generator 26 to generate an airflow so as to surround the person. More specifically, an airflow may be generated such that a second region A2 including a first region A1 in which the person is present is separated by the airflow from the other regions. This makes it possible to suppress droplet infection to a person when the person sits on a chair 30 immediately after coughing or sneezing by the person h1 is detected. In a case where coughing or sneezing by a person who is the only sitting person present is detected, the controller 25 may control the airflow generator 26 not to generate an airflow. Thus, the airflow generator 26 does not operate when the risk of droplet infection to another person is low. This allows a reduction in power consumption of the droplet infection suppression system 10.

As described above, the droplet infection suppression system 10 includes the airflow generator 26 capable of generating an airflow for separating the space into first regions A1, the human detector 31 that performs human detection in each of the first regions A1 (in the present embodiment, the human detector 31 detects a person sitting on one of the chairs 30 installed in the respective first regions A1), the detector 24 that detects coughing or sneezing, and the controller 25 that performs control such that when the detector 24 detects an occurrence of coughing or sneezing, the airflow generator 26 generates an airflow such that a second region A2 including one or more first regions A1 including a first region A1 in which the person detected by the human detector 31 is present is separated by the airflow from the other regions.

The controller 25 is capable of suppressing droplets, generated by coughing or sneezing by an infected person, reaching a region (another region) where another person is present by generating an airflow in response to detecting an occurrence of the coughing or sneezing, even in the case where the infected person is not identified in advance. That is, it is possible to suppress infection to other persons via coughing or sneezing. The controller 25 may control the airflow generator 26, capable of generating an airflow that separates the space into first regions A1, to generate a local airflow such that a second region A2 is separated by the local airflow from the other regions. As described above, the droplet infection suppression system 10 can suppress droplet infection by generating a local airflow even when the location of the infected person is unknown. Thus, according to the present embodiment, the droplet infection suppression system 10 can appropriately suppress droplet infection via coughing or sneezing by an infected person.

Droplets of coughing or sneezing reach 1 m away within, for example, 5 to 8 seconds, and thus it is highly likely that ordinary air conditioners and air cleaners are not capable of suppressing droplet infection because a blown wind does not reach the droplet in time. In contrast, in the droplet infection suppression system 10 according to the present embodiment, an airflow (for example, the airflow 26*b*) is generated directly from the desk 20 close to the location where the coughing or sneezing occurs, and thus it is possible to generate the airflow 26*b* in time.

This prevents droplet infection which is an event occurring during a short time. There is a possibility that the scattering velocity of coughing or sneezing differs depending on the person h. Therefore, for example, in a case where a microphone is used for detecting coughing or sneezing, the controller 25 may control the wind velocity of the airflow generated from the airflow generator 26 depending on the magnitude of the spectrum detected by the microphone. The controller 25 may increase the wind velocity as the magnitude of the detected spectrum increases. In this way, droplet infection can be prevented even for droplets that fly faster than usually expected.

Embodiment 2

A droplet infection suppression system 10 and related matters according to Embodiment 2 are described below with reference to FIGS. 7 and 8. Note that in the following description of Embodiment 2, differences from Embodiment 1 are mainly described, and a description of elements or processes similar to those in Embodiment 1 are omitted or simplified. The droplet infection suppression system 10 according to the present embodiment includes two or more detectors 24 for detecting an occurrence of coughing or sneezing. In the present embodiment, it is assumed that the desk 20 is used by many people, and two or more directional microphones are included in the desk 20 thereby performing a high accuracy detection on a location on the desk 20 where coughing or sneezing occurs. For example, the microphone may be embedded in the desk 20.

An airflow pattern is explained below for a case where the position of the person who coughs or sneezes can be identified, that is, the first region A1 in which the person who coughs or sneezes can be detected. The operation of the droplet infection suppression system 10 is basically similar to that of Embodiment 1, and thus only differences are described with reference to FIG. 3.

In the droplet infection suppression system 10 according to the present embodiment, when first coughing or sneezing is detected in step S20, a further determination is performed as to the position of a person who has coughed or sneezed. More specifically, the detector 24 identifies a first region A1 in which the person who has coughed or sneezed is present. Then, in step S30, the controller 25 calculates an airflow pattern depending on the first region A1 in which the person who has coughed or sneezed is present. More specifically, the controller 25 generates an airflow pattern that separates the person who has coughed or sneezed (an infected person) from other persons (susceptible persons). FIG. 7 is a diagram illustrating an example in which the droplet infection suppression system 10 according to the present embodiment generates an airflow for separating regions in response to detecting an occurrence of coughing or sneezing.

Figure 7:
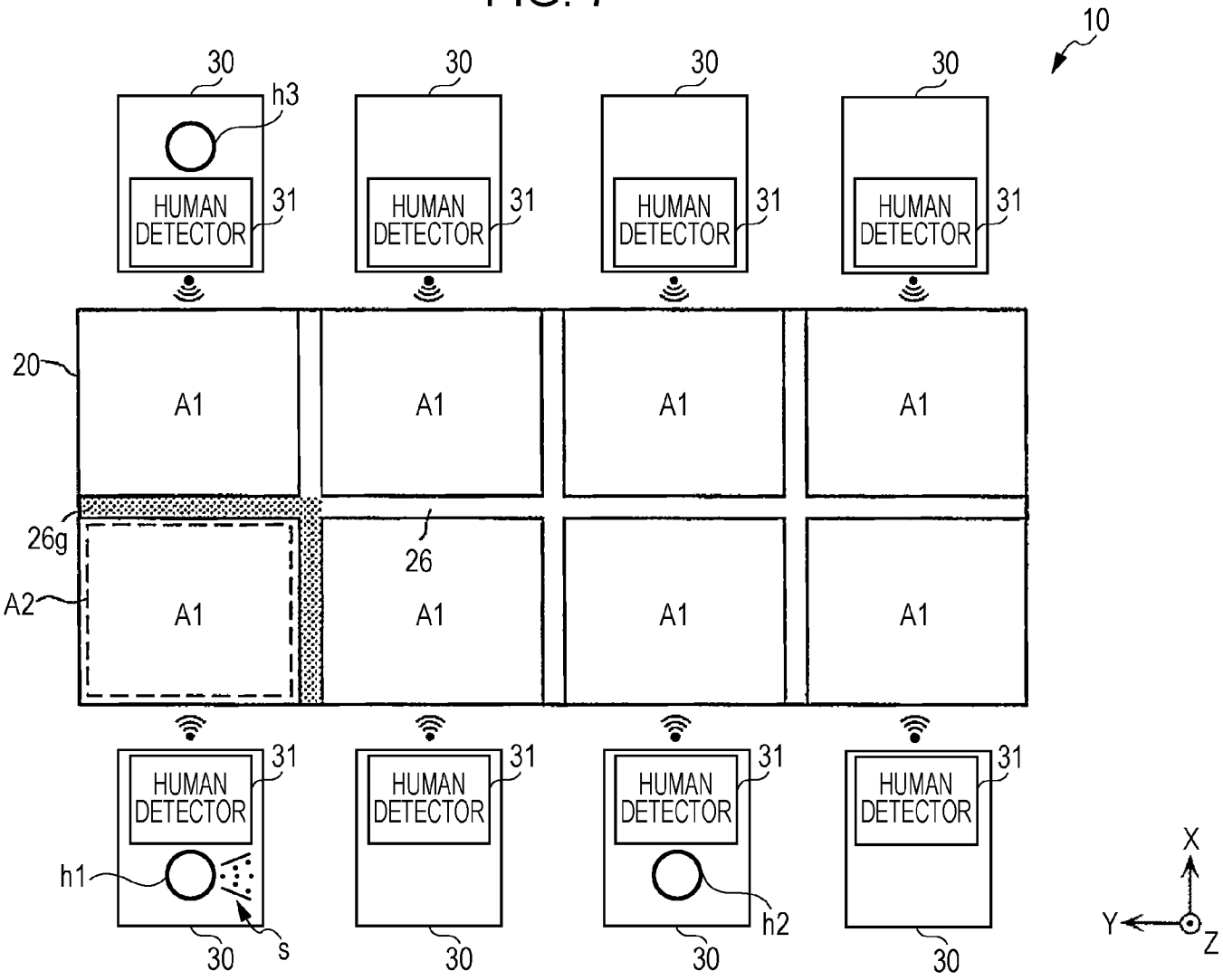
FIG. 7 is a diagram illustrating an example in which a region separation by an airflow is performed in response to detecting a cough or a sneeze in a droplet infection suppression system according to Embodiment 2.

As shown in FIG. 7, since the controller 25 has detected the person h1 who coughed or sneezed, the controller performs control to generate an airflow 26*g* having an airflow pattern that separates the person h1 from the other persons h2 and h3. More specifically, the controller 25 controls the airflow generator 26 to generate an airflow such that a second region A2 including a first region A1 in which the person h1 who has coughed or sneezed detected by the detector 24 is present is separated by the airflow from other regions. For example, the controller 25 performs the control so as to generate the airflow 26*g* having an airflow pattern surrounding the front and sides of the person h1. This results in a reduction in the part involving the generation of the airflow of the entire part of the airflow generator 26, thereby effectively suppressing droplet infection.

A further description is given below with reference to FIG. 8 for a case where a person h2 coughs or sneezes when the airflow 26*g* shown in FIG. 7 is being generated. FIG. 8 is a diagram illustrating another example in which the droplet infection suppression system 10 according to the present embodiment generates an airflow for separating regions in response to detecting an occurrence of coughing or sneezing.

Figure 8:
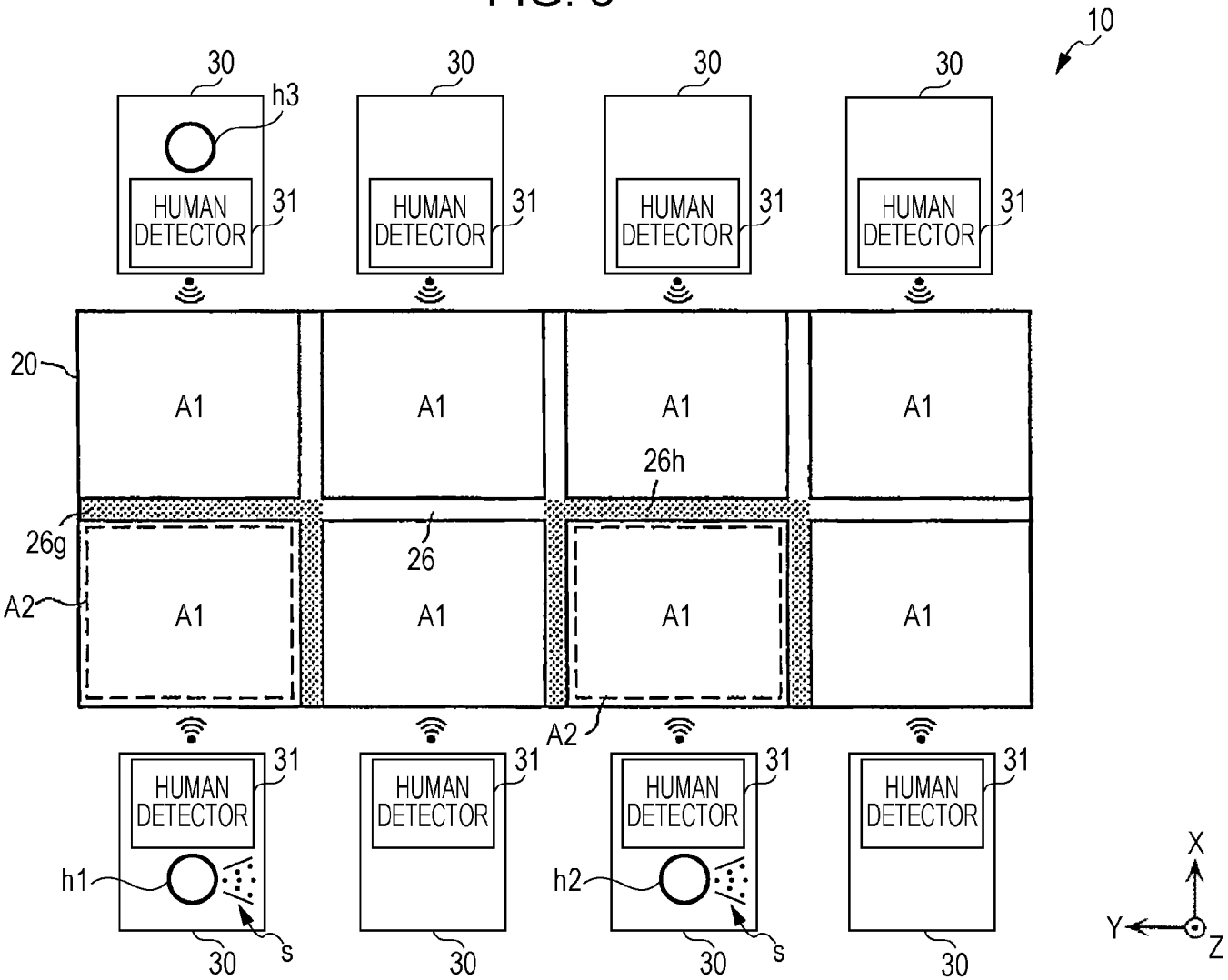
FIG. 8 is a diagram illustrating another example in which a region separation by an airflow is performed in response to detecting a cough or a sneeze in the droplet infection suppression system according to Embodiment 2.

As shown in FIG. 8, when the person h2 coughs or sneezes while the airflow 26*g* is being generated as shown in FIG. 7, the detector 24 detects that the person h2 has coughed or sneezed (which results in Yes in step S70 in FIG. 3). The controller 25 performs control so as to further generate an airflow 26*h* surrounding the person h2. More specifically, the controller 25 controls the airflow generator 26 to generate the airflow 26*h* such that a second region A2 including a first region A1 in which the person h2 who has coughed or sneezed detected by the detector 24 is present is separated by the airflow 26*h* from the other regions. Thus, it is possible to suppress droplet infection effectively even when two or more persons cough or sneeze.

Note that when the generation of the airflow 26*h* is started, the controller 25 does not necessarily reset the elapsed time during the generation of the airflow 26*g*. The airflow 26*g* may be stopped when the risk of infection due to coughing or sneezing by the person h is reduced while the airflow 26*h* is being generated. Thus, it is possible to appropriately suppress droplet infection while reducing the power consumption.

As described above, when the human detector 31 detects a person in two or more first regions A1 among the first regions A1, the detector 24 detects the first region A1 of the two or more first regions A1 in which the person is present who has coughed or sneezed. The controller 25 then controls the airflow generator 26 to generate an airflow (for example, an airflow 26*g*) such that a second region A2 including the first region A1 where the person who has coughed or sneezed is present detected by the detector 24 is separated by the airflow from the other regions.

Thus, it is sufficient to generate the airflow 26*g* that separates the second region including the first region A1 in which the person who has coughed or sneezed from the other regions. This may reduce the part involving the generation of the airflow (the operating part in the airflow generator 26) of the entire part of the airflow generator 26 and can separate a person who coughs or sneezes (an infected person) from another person (a susceptible person). That is, an airflow can be locally generated between a person who coughs or sneezes (for example, the person h1) and a person (for example, persons h2 and h3) who is present, for example, in front of the person thereby suppressing exposure of the person present in front of the coughing person to droplets s. Thus, it becomes possible to further appropriately suppress droplet infection caused by coughing or sneezing by an infected person. More specifically, the droplet infection can be suppressed while further reducing the power consumption of the droplet infection suppression system 10.

Other Embodiments

The droplet infection suppression system and the related matters have been described above with reference to various embodiments of one or more aspects of the disclosure. Note that the present disclosure is not limited to these embodiments. Note that various modifications and variations are possible to those skilled in the art without departing from the spirit of the present disclosure. All such modifications and variations fall in the scope of the disclosure.

For example, in the embodiments described above, the detector and the airflow generator are included in a desk, and the human detector is included in a chair. However, the present disclosure is not limited to such a configuration. In a case where the droplet infection suppression system is installed in an indoor space, it is sufficient to install the detector, the airflow generator, and the human detector in the space. For example, the detector, the airflow generator, and the human detector may be provided on a floor, a wall, a ceiling, or the like in the space. For example, they may be embedded in the floor, the wall, the ceiling, or the like.

In the embodiments described above, byway of example the airflow generator generates an airflow upward. However, the disclosure is not limited to this example. In a case where the airflow generator is provided at a position such as on a ceiling higher than the height of a person, the airflow generator may generate airflow downward (for example, toward a floor). In a case where the airflow generator is provided on a wall or the like, the airflow generator may generate an airflow so as to passing by a person.

In the embodiments described above, the airflow is stopped when the predetermined time elapses. However, the disclosure is not limited to this example. In a case where it is possible to identify a person who coughs or sneezes, an airflow may be continuously generated while the human detector detects the presence of the person who coughed or sneezed.

The communication method between the apparatuses (for example, between a desk and a chair) in the above embodiments is not particularly limited. Wireless communication or wired communication may be performed between apparatuses.

In the embodiments described above, byway of example, the droplet infection suppression system includes the airflow generator. The droplet infection suppression system may be a system that controls an airflow generator capable of generating an airflow that separates a space into two or more first regions. The droplet infection suppression system may not include the first detector and the second detector, but may include an acquirer that acquires detection results from the first detector and the second detector. That is, the droplet infection suppression system may be configured to include the acquirer (for example, the communicator) that acquires detection results from the first and second detectors, and a controller that outputs, to the airflow generator, a control signal that controls the airflow generator to generate an airflow such that a second region including one or more first regions including a first region in which a person detected by the first detector is present is separated by the airflow from the other regions. Note that "detecting a person" includes a case where the acquirer acquires the detection result from the first detector. That is, the droplet infection suppression system may detect a person by acquiring the detection result from the first detector. Note that "detecting coughing or coughing" includes a case where the acquirer acquires the detection result from the second detector. That is, the droplet infection suppression system may detect coughing or sneezing by acquiring the detection result from the second detector.

The order of executing the processes described in the embodiments is merely an example. The order of executing the processes may be changed. Some of the processes may be executed in parallel.

All or part of the components such as the controller in the embodiments described above may be realized by executing software programs suitable for the respective components. Each component may be implemented by a program execution unit such as a central processing unit (CPU) or a processor by reading out a software program from a storage medium such as a hard disk or a semiconductor memory and executing the read software program.

In the embodiments described above, all or part of the components such as the controller may be implemented by hardware. For example, a component such as a controller may be a circuit (or an integrated circuit). All components may be implemented by a single circuit, or the respective components may be implemented by separate circuits. Each of these circuits may be a general-purpose circuit or a dedicated circuit.

The present disclosure may be implemented as a program for causing a computer to execute processing performed by the droplet infection suppression system according to the embodiments described above. Such programs include application programs that are installed on a mobile terminal such as a smartphone or tablet device. The present disclosure may be implemented as a non-transitory computer-readable storage medium in which the programs are stored. The programs may be distributed via a transmission medium such as the Internet. The programs and digital signals of the programs may be transmitted via a telecommunication line, a wireless or wired communication line, a network represented by the Internet, a data broadcast, or the like. The programs and the digital signals of the programs may be stored in a storage medium and transported, or may be transmitted to another computer system via networks or the like and may be executed in the other computer system.

The numeric values such as the numbers, the ordinal numbers, and the amounts described in the embodiments are all illustrative in order to specifically describe the techniques of the present disclosure, and the present disclosure is not limited to these illustrated numeric values. The connection relationship among the components is illustrative in order to specifically explain the technique of the present disclosure, and the connection relationship for implementing the functions of the present disclosure is not limited thereto.

Note that other embodiments obtained by making various modifications conceivable by those skilled in the art to the embodiments, and embodiments realized by appropriately combining components and functions of the embodiments without departing from the spirit of the present disclosure also fall into the scope of the present disclosure.

The present disclosure is applicable, for example, to a desk or the like installed in a space where people gather and communicate with each other.

What is claimed is:

1. A droplet infection suppression system comprising:

an airflow generator configured to generate an airflow for separating a space into a plurality of regions;

first detectors corresponding one-to-one to the plurality of regions;

a second detector; and a controller which, when the second detector detects coughing or sneezing and the first detectors detect human presence in a first region of the plurality of regions, human presence in a second region of the plurality of regions, and no human presence in a third region of the plurality of regions, causes the airflow generator to generate an airflow, wherein the first region, the second region, and the third region are provided side by side and have no common region, the third region is provided between the first region and the second region, one or more additional regions of the plurality of regions are not provided between the first region and the second region, the airflow separates the first region and the second region, and the airflow does not separate the first region and the third region.

2. The droplet infection suppression system according to claim 1, wherein in a case where the first detectors detect human presence in two or more of the plurality of regions, the controller controls the airflow generator to generate an airflow so as to separate the two or more of the plurality of regions from each other.

3. The droplet infection suppression system according to claim 1, wherein in a case where the first detectors detect human presence in two or more of the plurality of regions and the second detector detects coughing or sneezing in one of the two or more of the plurality of regions, the controller controls the airflow generator to generate an airflow such that the one of the two or more of the plurality of regions is separated by the airflow from the other regions.

4. The droplet infection suppression system according to claim 1, further comprising a desk, wherein the airflow generator is included in the desk, and the airflow generator generates an airflow upward from the desk.

5. The droplet infection suppression system according to claim 4, wherein the airflow generator has a lattice shape in plan view of the desk.

6. The droplet infection suppression system according to claim 4, wherein the second detector is included in the desk.

7. The droplet infection suppression system according to claim 1, wherein the second detector includes a microphone or a camera.

8. The droplet infection suppression system according to claim 1, further comprising chairs respectively including the first detectors.

9. The droplet infection suppression system according to claim 1, wherein the first detector includes an infrared sensor or a pressure sensor.

10. A droplet infection suppression method performed using an airflow generator configured to generate an airflow for separating a space into a plurality of regions, first detectors corresponding one-to-one to the plurality of regions, and a second detector, the droplet infection suppression comprising:

when the second detector detects coughing or sneezing and the first detectors detect human presence in a first region of the plurality of regions, human presence in a second region of the plurality of regions, and no human presence in a third region of the plurality of regions, causes the airflow generator to generate an airflow, wherein the first region, the second region, and the third region are provided side by side and have no common region, the third region is provided between the first region and the second region, one or more additional regions of the plurality of regions are not provided between the first region and the second region, the airflow separates the first region and the second region, and the airflow does not separate the first region and the third region.

* * * * *